United States Patent [19]

Doddington et al.

[11] Patent Number: 4,696,040

[45] Date of Patent: Sep. 22, 1987

[54] SPEECH ANALYSIS/SYNTHESIS SYSTEM WITH ENERGY NORMALIZATION AND SILENCE SUPPRESSION

[75] Inventors: George R. Doddington; Panos E. Papamichalis, both of Richardson, Tex.

[73] Assignee: Texas Instruments Incorporated, Dallas, Tex.

[21] Appl. No.: 541,410

[22] Filed: Oct. 13, 1983

[51] Int. Cl.[4] ..... G10L 5/00

[52] U.S. Cl. ..... 381/46

[58] Field of Search ..... 381/36–53, 381/35

[56] References Cited

U.S. PATENT DOCUMENTS

| | | | |
|---|---|---|---|
| 4,071,695 | 1/1978 | Flanagan et al. | 171/1 VL |
| 4,280,192 | 7/1981 | Moll | 364/900 |
| 4,351,983 | 9/1982 | Grouse et al. | 179/1 SC |
| 4,384,169 | 5/1983 | Mozer et al. | 381/41 |
| 4,441,200 | 4/1984 | Fette et al. | 381/36 |
| 4,561,102 | 12/1985 | Prezas | 381/49 |

OTHER PUBLICATIONS

Electronics Letters, vol. 9, No. 14, 7/12/73, pp. 298–300.

New Electronics, vol. 15, No. 2, 1/82, pp. 30–32.

ICASSP 83, Proceedings of IEEE International Conference on ASSP, Boston, Mass., 4/1983, vol. 2, pp. 511–514.

IBM Tech. Disclosure Bulletin, vol. 20, No. 12, 5/78, pp. 5437–5440.

IBM Tech. Disclosure Bulletin, vol. 25, No. 7B, 12/82, pp. 3678–3680.

ICASSP 79, IEEE Conference, Washington, D.C., 4/79, pp. 212–215.

*Primary Examiner*—E. S. Matt Kemeny

*Attorney, Agent, or Firm*—Kenneth C. Hill; James T. Comfort; Melvin Sharp

[57] ABSTRACT

Energy normalization in speech synthesis systems is achieved by a look-ahead adaptive normalization procedure, wherein energy is adaptively tracked, and the adaptive energy-tracking value is used to normalize a much earlier frame's energy value.

26 Claims, 5 Drawing Figures

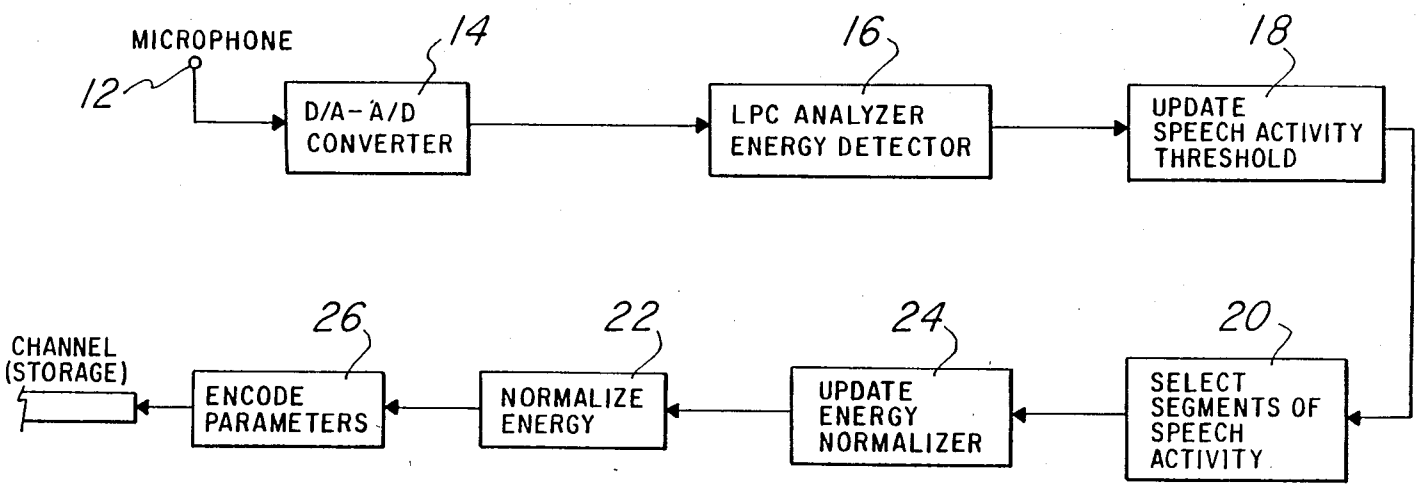
Fig.5 BLOCK DIAGRAM FOR SILENCE SUPPRESSION AND ENERGY NORMALIZATION

SPEECH ANALYSIS/SYNTHESIS SYSTEM WITH ENERGY NORMALIZATION AND SILENCE SUPPRESSION

BACKGROUND AND SUMMARY OF THE INVENTION

The present invention relates to voice coding systems.

A very large range of applications exists for voice coding systems, including voice mail in microcomputer networks, voice mail sent and received over telephone lines by microcomputers, user-programmed synthetic speech, etc.

In particular, the requirements of many of these applications are quite different from those of simple speech synthesis applications (such as a Speak & Spell) (TM)), wherein synthetic speech can be carefully encoded and then stored in a ROM or on disk. In such applications, high speed computers with elaborate algorithms, combined with hand tweaking, can be used to optimize encoded speech for good intelligibility and low bit requirements. However, in many other requirements, the speech encoding step does not have such large resources available. This is most obviously true in voice mail microcomputer networks, but it is also important in applications where a user may wish to generate his own reminder messages, diagnostic messages, signals during program operation, etc. For example, a microcomputer system wherein the user could generate synthetic speech messages in his own software would be highly desirable, not only for the individual user, but also for the software production houses which do not have trained speech scientists available.

A particular problem in such applications is energy variation. That is, not only will a speaker's voice intensity typically contain a large dynamic range related to sentence inflection, but different speakers will have different volume levels, and the same speaker's voice level may vary widely at different times. Untrained speakers are especially likely to use nonuniform uncontrolled variations in volume, which the listener normally ignores. This large dynamic range would mean that the voice coding method used must accommodate a wide dynamic range, and therefore an increased number of bits would be required for coding at reasonable resolution.

However, if energy normalization can be used (i.e. all speech adjusted to approximately a constant energy level) these problems are ameliorated.

Energy normalization also improves the intelligibility of the speech received. That is, the dynamic range available from audio amplifiers and loudspeakers is much less than that which can easily be perceived by the human ear. In fact, the dynamic range of loudspeakers is typically much less than that of microphones. This means that a dynamic range which is perfectly intelligible to a human listener may be hard to understand if communicated through a loudspeaker, even if absolutely perfect encoding and decoding is used.

The problem of intelligibility is particularly acute with audio amplifiers and loudspeakers which are not of extremely high fidelity. However, compact low-fidelity loudspeakers must be used in most of the most attractive applications for voice analysis/synthesis, for reasons of compactness, ruggedness, and economy.

A further desideratum is that, in many attractive applications, the person listening to synthesized speech should not be required to twiddle a volume control frequently. Where a volume control is available, dynamic range can be analog-adjusted for each received synthetic speech signal, to shift the narrow window provided by the loudspeaker's narrow dynamic range, but this is obviously undesirable for voice mail systems and many other applications.

In the prior art, analog automatic gain controls have been used to achieve energy normalization of raw signals. However, analog automatic gain controls distort the signal input to the analog to digital converter. That is, where (e.g.) reflection coefficients are used to encode speech data, use of an automatic gain control in the analog signal will introduce error into the calculated reflection coefficients. While it is hard to analyze the nature of this error, error is in fact introduced. Moreover, use of an analog automatic gain control requires an analog part, and every introduction of special analog parts into a digital system greatly increases the cost of the digital system. If an AGC circuit having a fast response is used, the energy levels of consecutive allophones may be inappropriate. For example, in the word "six" the sibilant /s/ will normally show a much lower energy than the vowel /i/. If a fast-response AGC circuit is used, the energy-normalized-word "six" is left with a sound extremely hissy, since the initial /s/ will be raised to the same energy as the i/i/, inappropriately. Even if a slower-response AGC circuit is used, substantial problems still may exist, such as raising the noise floor up to signal levels during periods of silence, or inadequate limiting of a loud utterance following a silent period.

Thus it is an object of the present invention to provide a digital system which can perform energy normalization of voice signals.

It is further object of the present invention to provide a method for energy normalization of voice signals which will not overemphasize initial constants.

It is a further object of the present invention to provide a method for energy normalization of voice signals which can rapidly respond to energy variations in a speaker's utterance, without excessively distorting the relative energy levels of adjacent allophones with an utterance.

A further general problem with energy normalization is caused by the existence of noise during silent periods. That is, if an energy normalization system brings the noise floor up towards the expected normal energy level during periods when no speech signal is present, the intelligibility of speech will be degraded and the speech will be unpleasant to listen to. In addition, substantial bandwidth will be wasted encoding noise signals during speech silence periods.

It is a further object of the present invention to provide a voice coding system which will not waste bandwidth on encoding noise during silent periods.

The present invention solves the problems of energy normalization digitally, by using look-ahead energy normalization. That is, an adaptive energy normalization parameter is carried from frame to frame during a speech analysis portion of an analysis-synthesis system. Speech frames are buffered for a fairly long period, e.g. ½ second, and then are normalized according to the current energy normalization parameter. That is, energy normalization is "look ahead" normalization in that each frame of speech (e.g. each 20 millisecond interval of speech) is normalized according to the energy normalization value from much later, e.g. from 25 frames later. The energy normalization value is calculated for the frames as received by using a fast-rising slow-falling peak-tracking value.

In a further aspect of the present invention, a novel silence suppression scheme is used. Silence suppression is achieved by tracking 2 additional energy contours. One contour is a slow-rising fast-falling value, which is updated only during unvoiced speech frames, and therefore tracks a lower envelope of the energy contour. (This in effect tracks the ambient noise level.) The other parameter is a fast-rising slow-falling parameter, which is updated only during voiced speech frames, and thus tracks an upper envelope of the energy contour. (This in effect tracks the average speech level.) A threshold value is calculated as the maximum of respective multiples of these 2 parameters, e.g. the greater of: (5 times the lower envelope parameter), and (one fifth of the upper envelope parameter). Speech is not considered to have begun unless a first frame which *both* has an energy above the threshold level *and* is also voiced is detected. In that case, the system then backtracks among the buffered frames to include as "speech" all immediately preceding frames which also have energy greater than the threshold. That is, after a period during which the frames of parameters received have been identified as silent frames, all succeeding frames are tentively identified as silent frames, until a super-threshold-energy voiced frame is found. At that point, the silence suppression system backtracks among frames immediately preceding this super-threshold energy voiced frame until an broken string subthreshold-energy frames at least to 0.4 seconds long is found. When such a 0.4 second interval of silence is found, backtracking ceases, and only those frames after the 0.4 seconds of silence and before the first voiced super-threshold energy frame are identified as non-silent frames.

At the end of speech, when a voiced frame is detected having an energy below the threshold T, a waiting counter is started. If the waiting reaches an upper limit (e.g. 0.4 seconds), without the energy again increasing above T, the utterance is considered to have stopped. The significance of the speech/silence decision is that bits are not wasted on encoding silent frames, energy tracking is not distorted by the presence of silent frames as discussed above, and long utterances can be input from an untrained speakers, who are likely to leave very long silences between consecutive words in a sentence.

According to the present invention there is provided:

A speech coding system, comprising:

An analyzer connected to receive a digital speech signal and to generate therefrom a sequence of frames of speech parameters, said parameters of each frame including an energy value, and means for normalizing the energy value of each said speech frame with respect to energy values of subsequent frames; and output means for loading said parameters for each said speech frame including said normalized energy parameter of each said speech frame into a data channel.

According to the present invention there is provided:

A method of encoding speech, comprising the steps of:

Analyzing a speech signal to provide a sequence of frames as speech parameters, each said frame of said sequence of parameters including an energy value;

normalizing said energy values of each of said speech frames with respect to energy values of subsequent ones of said speech frames; and encoding said speech parameters including said normalized ones of said energy values into a data channel.

BRIEF DESCRIPTION OF THE DRAWINGS

The present invention will be described with reference to the accompanying drawings, which are hereby incorporated by reference and attested to by the attached Declaration, wherein:

FIG. 5 shows a sample system configuration for practicing the present invention.

DESCRIPTION OF THE PREFERRED EMBODIMENTS

Figure 1:
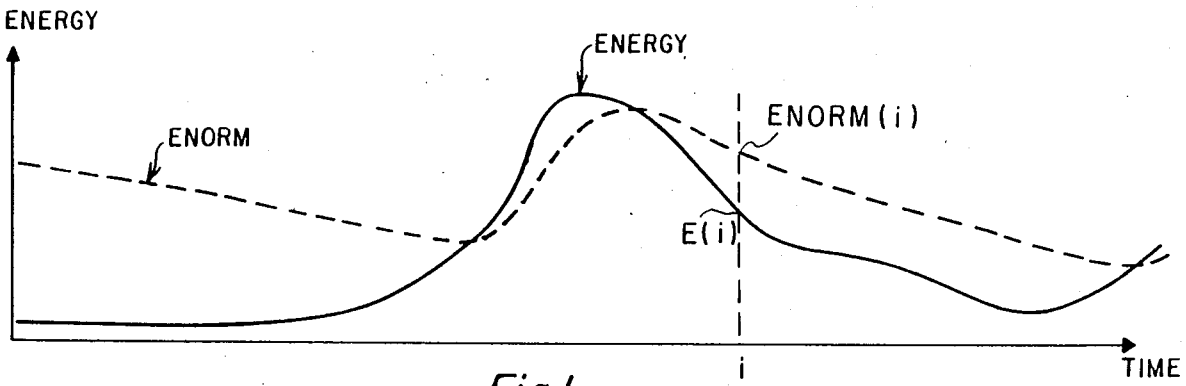
FIG. 1 shows one aspect of the present invention, wherein an adaptively normalized energy level ENORM is derived from the successive energy levels of a sequence of speech frames.
Figure 2:
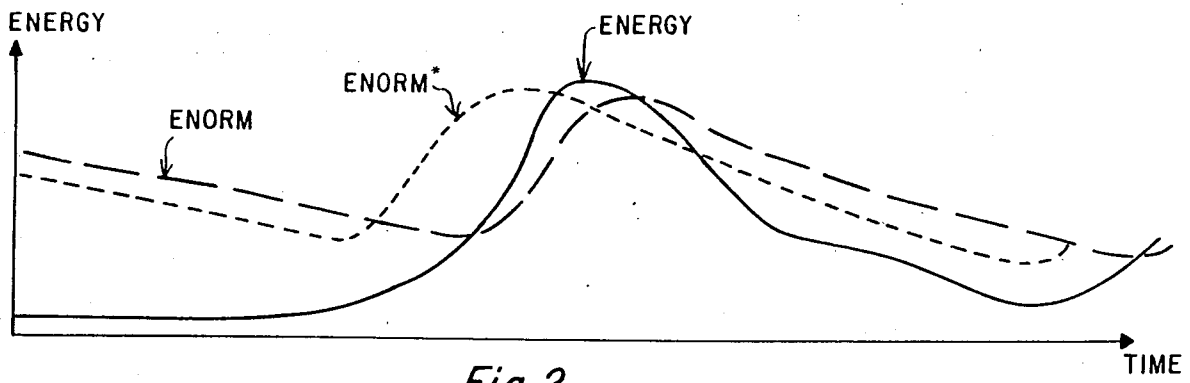
FIG. 2 shows a further aspect of the present invention, wherein a look-ahead energy normalization curve ENORM* is used for normalization.

The present invention provides a novel speech analysis/synthesis system, which can be configured in a wide variety of embodiments. However, the presently preferred embodiment uses a VAX 11/780 computer, coupled with a Digital Sound Corporation Model 200 A/D and D/A converter to provided high-resolution high-bit-rate digitizing and to provide speech synthesis. Naturally, a conventional microphone and loudspeaker, with an analog amplifier such as a Digital Sound Corporation Model 240, are also used in conjunction with the system.

However, the present invention contains novel teachings which are also particularly applicable to microcomputer-based systems. That is, the high resolution provided by the above digitizer is not necessary, and the computing power available on the VAX is also not necessary. In particular, it is expected that a highly attractive embodiment of the present invention will use a TI Professional Computer (TM), using the built in low-quality speaker and an attached microphone as discussed below.

The system configuration of the presently preferred embodiment is shown schematically in FIG. 5. That is, a raw voice input is received by microphone 10, amplified by microphone amplifier 12, and digitized by D/A converter 14. The D/A converter used in the presently preferred embodiment, as noted, is an expensive high-resolution instrument, which provides 16 bits of resolution at a sample rate of 8 kHz. The data received at this high sample rate will be transformed to provide speech parameters at a desired frame rate. In the presently preferred embodiment the frame rate is 50 frames per second, but the frame period can easily range between 10 milliseconds and 30 milliseconds, or over an even wider range.

In the presently preferred embodiment, linear predictive coding based analysis is used to encode the speech. That is, the successive samples (at the original high bit rate, of, in this example, 8000 per second) are used as inputs to derive a set of linear predictive coding parameters, for example 10 reflection coefficants $k_1$–$k_{10}$ plus pitch and energy, as described below.

In practicing the present invention, the audible speech is first translated into a meaningful input for the system. For example, a microphone within range of the audible speech is connected to a microphone preamplifier and to an analog-to-digital converter. In the presently preferred embodiment, the input stream is sampled 8000 times per second, to an accuracy of 16 bits. The stream of input data is then arbitrarily divided up into successive "frames", and, in the presently preferred embodiment, each frame is defined to include 160 samples. That is, the interval between frames is 20 msec, but the LPC parameters of each frame are calculated over a range of 240 samples (30 msec).

In one embodiment, the sequence of samples in each speech input frame is first transformed into a set of inverse filter coefficients $a_k$, as conventionally defined. See, e.g., Makhoul, "Linear Prediction: A Tutorial Review", proceedings of the IEEE, Volume 63, page 561 (1975), which is hereby incorporated by reference. That is, in the linear prediction model, the $a_k$'s are the predictor coefficients with which a signal $S_k$ in a time series can be modeled as the sum of an input $u_k$ and a linear combination of past values $S_{k-n}$ in the series. That is:

$$S_n = -\sum_{k=1}^{p} a_k s_{n-k} + Gu_n \tag{1}$$

Each input frame contains a large number of sampling points, and the sampling points within any one input frame can themselves be considered as a time series. In one embodiment, the actual derivation of the filter coefficients $a_k$ for the sample frame is as follows: First, the time-series autocorrelation values $R_i$ are computed as $$R_i = \sum_n s_n s_{n+i} \tag{2}$$

where the summation is taken over the range of samples within the input frame. In this embodiment, 11 autocorrelation values are calculated ($R_0$–$R_{10}$). A recursive procedure is now used to derive the inverse filter coefficients as follows:

$$E_0 = R(0) \tag{3}$$

$$k_i = -\left[ R_{(i)} + \sum_{j=1}^{i-1} a_j^{(i-1)} R_{(i-j)} \right. \tag{4}$$

$$a_i^{(i)} = k_i$$

$$a_j^{(i)} = a_j^{(i-1)} + k_i a_{i-j}^{(i-1)}, \text{ for } 1 \leqq j \leqq i-1 \tag{5}$$

$$E_i = (1 - k_i^2) E_{i-1} \tag{6}$$

These equations are solved recursively for: i=1, 2, . . . , up to the model order p (p=10 in this case). The last iteration gives the final $a_k$ values.

The foregoing has described an embodiment using Durbin's recursive procedure to calculate the $a_k$'s for the sample frame. However, the presently preferred embodiment uses a procedure due to Leroux-Gueguen. In this procedure, the normalized error energy E (i.e. the self-residual energy of the input frame) is produced as a direct byproduct of the algorithm. The Leroux-Gueguen algorithm also produces the reflection coefficients (also referred to as partial correlation coefficients) $k_i$. The reflection coefficients $k_r$ are very stable parameters, and are insensitive to coding errors (quantization noise).

The Leroux-Gueguen procedure is set forth, for example, in IEEE Transactions on Acoustic Speech and Signal Processing, page 257 (June 1977), which is hereby incorporated by reference. This algorithm is a recursive procedure, defined as follows:

$$k_h = -e_{h+1}^{(h)} / e_o^{(h)} \tag{7}$$

$$e_o^{(h+1)} = e_o^{(h)} (1 - k_h^2) \tag{8}$$

$$e_i^{(h+i)} = e_i^{(h)} + k_h e_{h+1-i}^{(h)} \tag{9}$$

This algorithm computes the reflection coefficients $k_i$ using as intermediaries impulse response estimates $e_k$ rather then the filter coefficients $a_k$.

Linear predictive coding models generally are well known in the art, and can be found extensively discussed in such references as Rabiner and Schafer, *Digital Processing of Speech Signals* (1978), Markel and Gray, *Linear Predictive Coding of Speech* (1976), which are hereby incorporated by reference, and in many other widely available publications. It should be noted that the excitation coding transmitted need not be merely energy and pitch, but may also contain some additional information regarding a residual signal. For example, it would be possible to encode a bandwidth of the residual signal which was an integral multiple of the pitch, and approximately equal to 1000 Hz, as an excitation signal. Such a technique is extensively discussed in Patent Application Ser. No. 484,720, filed Apr. 13, 1983, which is hereby incorporated by reference. Many other well-known variations of encoding the excitation information can also be used alternatively. Similarly, the LPC parameters can be encoded in various ways. For example, as is also well known in the art, there are numerous equivalent formulations of linear predictive coefficients. These can be expressed as the LPC filter coefficients $a_k$, or as the reflection coefficients $k_i$, or as the autocorrelations $R_i$, or as other parameter sets such as the impulse response estimates parameters E(i) which are provided by the LeRoux-Guegen procedure. Moreover, the LPC model order is not necessarily 10, but can be 8, 12, 14, or other.

Moreover, it should be noted that the present invention does not necessarily have to be used in combination with an LPC speech encoding model at all. That is, the present invention provides an energy normalization method which digitally modifies only the energy of each of a sequence of speech frames, with regard to only the energy and voicing of each of a sequence of speech frames. Thus, the present invention is applicable to energy normalization of the systems using any one of a great variety of speech encoding methods, including transform techniques, formant encoding techniques, etc.

Thus, after the input samples have been converted to a sequence of speech frames each having a data vector including an energy value, FIG. 5, item 16) the present invention operates on the energy value of the data vectors. In the presently preferred embodiment, the encoded parameters are the reflection coefficients $k_1$–$k_{10}$, the energy, and pitch. (The pitch parameter includes the voicing decision, since an unvoiced frame is encoded as pitch=zero.)

The novel operations in the system of the present invention begin at this point. That is, a sequence of encoded frames, each including an energy parameter and modeling parameters, is provided as the raw output of the speech analysis section. Note that, at this stage, the resolution of the energy parameter coding is much higher than it will be in the encoded information which is actually transmitted over the communications or storage channel 40. The way in which the present invention performs energy normalization on successive frames, and suppresses coding of silent frames, may be seen with regard to the energy diagrams of FIGS. 1–4. These show examples of the energy values E(i) seen in successive frames i within sequence of frames, as received as raw output in the speech analysis section.

An adaptive parameter ENORM(i) is then generated, approximately as shown in FIG. 1. That is, ENORM(0) is an initial choice for that parameter, e.g. ENORM(0)=100. ENORM is subsequently updated, for each successive frame, as follows:

If E(i) is greater than ENORM(i−1), then ENORM (i) is set equal to alpha times E(i)+(1−alpha) times ENORM(i−1);

Otherwise, ENORM(i) is set equal to beta times E(i)+(1−beta) times ENORM(i−1), where alpha is given a value close to 1 to provide a fast rising time constant (preferably about 0.1 seconds), and Beta has given a value close to 0, to provide a slow falling time constant (preferably in the neighborhood of 4 seconds).

This adaptive peak-tracking parameter ENORM(i) is used to normalize the energy of the frames, but this not done directly. The energy of each frame I is normalized by dividing it by a look ahead normalized energy ENORM*(i), where ENORM*(i) is defined to be equal to ENORM(i+d), where d represents a number of frames of delay which is typically chosen to be equivalent to ½ second (but may be in the range of 0.1 to 2 seconds, or even have values outside this range). Thus, the energy E(i) of each frame is normalized by dividing by the normalized energy ENORM*(i):

E*(i) is set equal to E(i)/ENORM*(i).

This is accomplished by buffering a number of speech frames equal to the delay d, so that the value of ENORM for the last frame loaded into the buffer provides the value of ENORM* for the oldest frame in the buffer, i.e. for the frame currently being taken out of the buffer.

The introduction of this delay in the energy normalization means that the energy of initial low-energy periods will be normalized with respect to the energy of immediately following high-energy periods, so that the relative energy of initial consonants will not be distorted. That is, unvoiced frames of speech will typically have an energy value which is much lower than that of voiced frames of speech. Thus, in the word "six" the initial allophone/s/ should be normalized with respect to the energy level of the vowel allophone /i/. If the allophone /s/ is normalized with respect to its own energy, then it will be raised to an improperly high energy, and the initial consonant /s/ will be greatly overemphasized.

Since the falling time constant (corresponding to the parameter beta) is so long, energy normalization at the end of a word will not be distorted by the approximately zero-energy value of the following frames of silence. (In addition, when silence suppression is used, as is preferable, the silence suppression will prevent ENORM from falling very far in this situation.) That is, for a final unvoiced consonant, the long time constant corresponding to beta will means that the energy normalization value ENORM of the silent frames ½ second after the end of a word will be still be dominated by the voiced phonemes immediately preceding the final unvoiced consonant. Thus, the final unvoiced constant will be normalized with respect to preceeding voiced frames, and its energy also will not be unduly raised. Normalization is done in FIG. 5, items 22 and 24. Determination of voiced or unvoiced frames is done in item 18.

Thus, the foregoing steps provide a normalized energy E*(i) for each speech frame i. In the presently preferred embodiment, a further novel step is used to suppress silent periods. As shown in the diagram of FIG. 5, silence detection is used to selectively prevent certain frames from being encoded (item 20). Those frames which are encoded are encoded with a normalized energy E*(i), together with the remaining speech parameters in the chosen model (which in the presently preferred embodiment are the pitch P and the reflection coefficients $k_1$–$k_{10}$).

Silence suppression is accomplished in a further novel aspect of the present invention, by carrying 2 envelope parameters: ELOW and EHIGH. Both of these parameters are started from some initial value (e.g. 100) and then are updated depending on the energy E(i) of each frame i and on the voiced or unvoiced status of that frame. If the frame is unvoiced, then only the lower parameter ELOW is updated as follows:

If E(i) is greater than ELOW, then ELOW is set equal to gamma times E(i)+(1−gamma) times ELOW;

otherwise, ELOW is set equal to delta times E(i)+(1−delta) times ELOW, where gamma corresponds to a slow rising time constant (typically 1 second), and delta corresponds to a fast falling time constant (typically 0.1 second). Thus, ELOW in effect tracks a lower envelope of the energy contour of EI. The parameters gamma and delta are referred to in the accompanying software as ALOWUP and ALOWDN.

Figure 3:
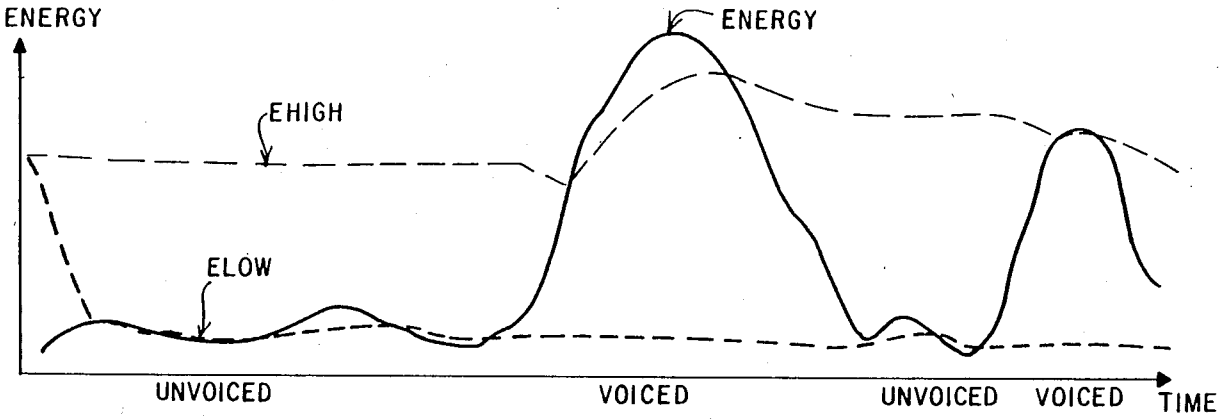
FIG. 3 shows a further aspect of the present invention, used in silence suppression, wherein high and low envelope curves are continuously maintained for the energy values of a sequence of speech input frames.
Figure 4:
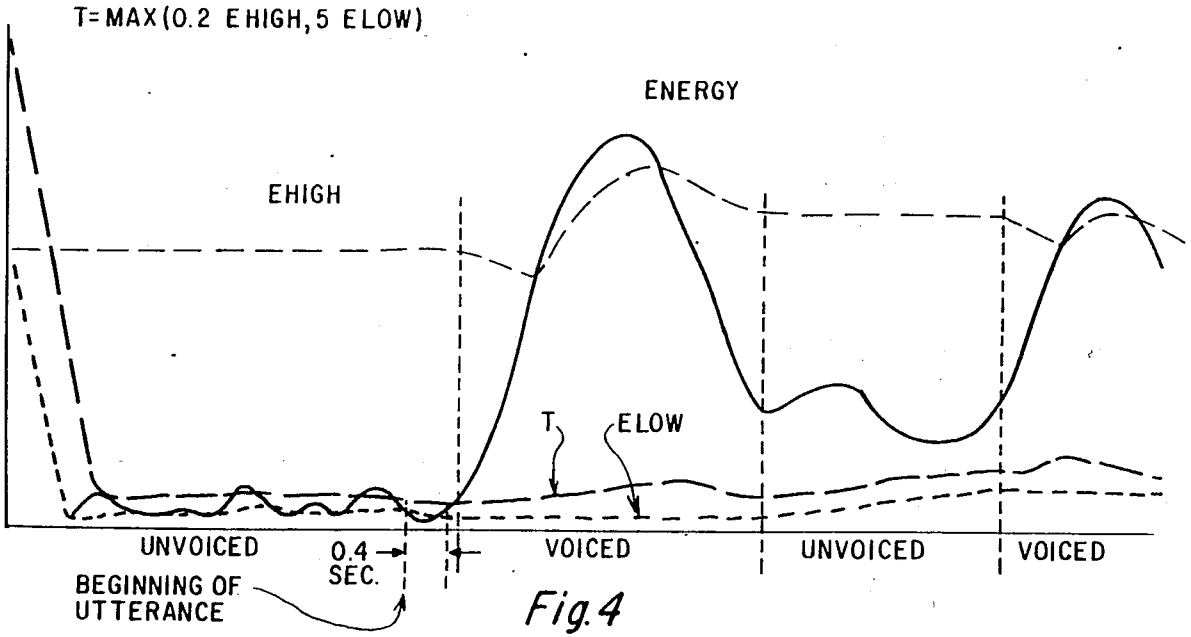
FIG. 4 shows a further aspect of the invention, wherein the EHIGH and ELOW curves of FIG. 3 are used to derive a threshold curve T.

If the frame I is voiced, then only EHIGH is updated, as follows:

If E(i) is greater then EHIGH, the EHIGH is set equal to epsilon times E(i)+(1−epsilon) times EHIGH;

otherwise, EHIGH is set equal to zeta times E(i)+(1−zeta) times EHIGH, where epsilon corresponds to a fast rising time constant (typically 0.1 seconds), and zeta corresponds to a fast falling time constant (typically 1 second). Thus, EHIGH tracts an upper envelope of the energy contour. The parameters ELOW and EHIGH are shown in FIG. 3. Note that the parameter EHIGH is not updated during the initial unvoiced series of frames, and the parameter ELOW is not disturbed during the following voiced series of frames.

The 2 envelope parameters ELOW and EHIGH are then used to generate 2 threshold parameters TLOW and THIGH, defined as:

TLOW=PL times ELOW

THIGH=PH times EHIGH, where PL and PH are scaling factors (e.g. PL=5 and PH=0.2). A threshold T is then set as the maximum of TLOW and THIGH.

Based on this threshold T, a decision is made whether a frame is nonsilent or silent, as follows:

If the current frame is a silent frame, all following frames will be tentatively assumed to be silent unless a voiced super-threshold-energy (and therefore nonsilent) frame is detected. The frames tentatively assumed to be silent will be stored in a buffer (preferable containing at least one second of data), since they may be identified later as *not* silent. A speech frame is detected only when some frame is found which has a frame energy E(i) greater than the threshold T *and which is voiced.* That is, an unvoiced super-threshold-energy frame is not by itself enough to cause a decision that speech has begun. However, once a voiced high energy frame is found, the prior frames in the buffer are reexamined, and all immediately preceding unvoiced frames which have an energy greater than T are then identified as nonsilent frames. Thus, in the sample word "six", the unvoiced super-threshold-energy frames in the constant /s/ would not immediately trigger a decision that a speech signal had begun, but, when the voiced super-threshold-energy frames in the /i/ are detected, the immediately preceding frames are reexamined, and the frames corresponding to the /s/ which have energy greater than T are then also designated as "speech" frames.

If the current frame is a "speech" (nonsilent) frame, the end of the word (i.e. the beginning of "silent" frames which need not be encoded) is detected as follows. When a voiced frame is found which has its energy E(i) less than T, a waiting counter is started. If the waiting reaches an upper limit (e.g. 0.4 seconds) without the energy ever rising above T, then speech is determined to have stopped, and frames after the last frame which had energy E(i) greater than T are considered to be silent frames. These frames are therefore not encoded.

It should be noted that the energy normalization and silence suppression features of the system of the present invention are both dependant in important ways on the voicing decision. It is preferable, although not strictly necessary, that the voicing decision be made by means of a dynamic programming procedure which makes pitch and voicing decisions simultaneously, using an interrelated distance measure (item 18 in FIG. 5). Such a system is presently preferred, and is described in greater detail in U.S. Patent Application Ser. No. 484,718, filed Apr. 13, 1983, which is hereby incorporated by reference. It should also be noted that this system tends to classify low-energy frames as unvoiced. This is desirable.

The actual encoding can now be performed with a minimum bit rate. In the presently preferred embodiment, 5 bits are used to encode the energy of each frame, 3 bits are used for each of the ten reflection coefficients, and 5 bits are used for the pitch. However, this bit rate can be further compressed by one of the many variations of delta coding, e.g. by fitting a polynomial to the sequence of parameter values across successive frames and then encoding merely the coefficients of that polynomial, by simple linear delta coding, or by any of the various well known methods. (FIG. 5, item 26)

In a further attractive contemplated embodiment of the invention, an analysis system as described above is combined with speech synthesis capability, to provide a voice mail station, or a station capable of generating user-generated spoken remainder messages. This combination is easily accomplished with minimal required hardware addition. The encoded output of the analysis section, as described above, is connected to a data channel of some sort. This may be a wire to which an RS 232 UART chip is connected, or may be a telephone line accessed by a modem, or may be simply a local data buss which is also connected to a memory board or memory chips, or may of course be any of a tremendous variety of other data channels. Naturally, connection to any of these normal data channels is easily and conveniently made two way, so that data may be received from a communication channel or recalled from memory. Such data received from the channel will thus contain a plurality of speech parameters, including an energy value.

In the presently preferred embodiment, where LPC speech modeling is used, the encoded data received from the data channel will contain LPC filter parameters for each speech frame, as well as some excitation information. In the presently preferred embodiment, the data vector for each speech frame contains 10 reflection coefficients as well as pitch and energy. The reflection coefficients configure a tense-order lattice filter, and an excitation signal is generated from the excitation parameters and provided as input to this lattice filter. For example, where the excitation parameters are pitch and energy, a pulse, at intervals equal to the pitch period, is provided as the excitation function during voiced frames (i.e. during frames when the encoded value of pitch is non zero), and pseudo-random noise is provided as the excitation function when pitch has been encoded as equal to zero (unvoiced frames). In either case, the energy parameter can be used to define the power provided in the excitation function. The output of the lattice filter provides the LPC-modeled synthetic signal, which will typically be of good intelligible quality, although not absolutely transparent. This output is then digital-to-analog converted, and the analog output of the d-a converter is provided to an audio amplifier, which drives a loudspeaker or headphones.

In a further attractive alternative embodiment of the present invention, such a voice mail system is configured in a microcomputer-based system. In this embodiment, at Texas Instruments Professional Computer TM with a speech board incorporated is used as a voice mail terminal. This configuration uses a 8088-based system, together with a special board having a TMS 320 numeric processure chip mounted thereon. The fast multiple provided by the TMS 320 is very convenient in performing signal processing functions. A pair of audio amplifiers for input and output is also provided on the speech board, as is an 8 bit mu-law codec. The function of this embodiment is essentially identical to that of the VAX embodiment described above, except for a slight difference regarding the converters. The 8 bit codec performs mu-law conversion, which is non linear but provides enhanced dynamic range. A lookup table is used to transform the 8 bit mu-law output provided from the codec chip into a 13 bit linear output. Similarly, in a speech synthesis operation, the linear output of the lattice filter operation is pre-converted, using the same lookup table, to an 8-bit word which will give an appropriate analog output signal from the codec. This microcomputer embodiment also includes an internal speaker, and a microphone jack.

A further preferred realization is the use of multiple micro-computer based voice mail stations, as described above, to configure a microcomputer-based voice mail system. In such a system, microcomputers are conventionally connected in a local area network, using one of the many conventional LAN protocalls, or are connected using PBX tilids. The only slightly distinctive feature of this voice mail system embodiment is that the transfer mechnizam used must be able to pass binary data, and not merely ASCII data. As between microcomputer stations which have the voice mail analysis/synthesis capabilities discussed above, the voice mail operation is simply a straight forward file transfer, wherein a file representing encoded speech data is generated by an analysis operation at one station, is transferred as a file to another station, and then is converted to analog speech data by a synthesis operation at the second station.

Thus, the crucial changes taught by the present invention are changes in the analysis portion of an analysis/synthesis system, but these changes affect the system as a whole. That is, the system as a whole will achieve higher throughput of intelligible speech information per transmitted bit, better perceptual quality of synthesized sound at the synthesis section, and other system-level advantages. In particular, microcomputer network voice mail systems perform better with minimized channel loading according to the present invention.

Thus, the present invention provides the objects described above, of energy normalization and of silent suppression, as well as other objects, advantageously.

As will be obvious to those skilled in the art, the present invention can be practiced with a wide variety of modifications and variations, and is not limited except as specified in the accompanying claims.

What is claimed is:

1. A speech coding system, comprising:

an analyzer for receiving a digital speech signal and generating therefrom a sequence of frames, each frame having speech parameters, said parameters of each frame including an energy value;

means coupled to said analyzer for normalizing the energy value of each said speech frame with respect to energy values of subsequently generated frames of the sequence; and means coupled to said normalizing means for loading said parameters for each said speech frame of the sequence, including said normalized energy parameter of each said speech frame, into a data channel.

2. The system of claim 1, further comprising:

a data converter connected to receive an analog speech signal, said data converter providing to said analyzer a digital speech signal corresponding to said analog speech signal.

3. The system of claim 1, wherein said energy value of each speech frame is normalized with respect to said energy values of those frames which are later than the frame undergoing energy normalization by at least 0.1 second.

4. The system of claim 1, wherein said energy value of each speech frame is normalized with respect to a peak-tracking parameter of subsequent frames, said peak-tracking parameter corresponding to an upper envelope of the sequence of said energy values of the subsequent frames.

5. The system of claim 3, wherein said energy value of each speech frame is normalized with respect to a peak-tracking parameter of subsequent frames, said peak-tracking parameter corresponding to an upper envelope of the sequence of said energy values of the subsequent frames.

6. The system of claim 1, wherein said analyzer is a linear predictive coding analyzer.

7. The system of claim 1, wherein said speech parameters of each of said frame also indicate the voiced/unvoiced status of said respective frame.

8. The system of claim 7, wherein said parameters also include pitch information for each of said speech frames, and wherein said analyzer jointly determines pitch and voicing of each frame, so that the said pitch and voicing decisions vary as smoothly as possible across adjacent frames.

9. The system of claim 3, wherein said speech parameters comprise linear predictive coding parameters.

10. The system of claim 9, wherein said speech parameters include excitation information in addition to said linear predictive coding parameters.

11. The system of claim 10, wherein said excitation information consists only of pitch, energy, and voicing information.

12. The system of claim 9, wherein said linear predictive coding parameters comprise reflection coefficients.

13. The system of claim 9, wherein said linear predictive coding parameters correspond to a tenth-order linear predictive coding model.

14. A method of encoding speech, comprising the steps of:

analyzing a speech signal to provide a sequence of frames, each frame having speech parameters, each frame of said sequence including an energy value;

normalizing said energy values of each of said speech frames with respect to energy values of subsequently generated ones of said speech frames; and encoding said speech parameters, including said energy values, into a data channel.

15. The method of claim 14, further comprising:

providing to said analyzer a digital speech signal corresponding to an analog speech signal.

16. The method of claim 14, wherein said energy value of each speech frame is normalized with respect to said energy values of only those frames which are later than the frame undergoing energy normalization by at least 0.1 second.

17. The method of claim 14, wherein said energy value of each speech frame is normalized with respect to a peak-tracking parameter of subsequent frames, said peak-tracking parameter corresponding to an upper envelope of the sequence of said energy values of the subsequent frames.

18. The method of claim 16, wherein said energy value of each speech frame is normalized with respect to a peak-tracking parameter of subsequent frames, said peak-tracking parameter corresponding to an upper envelope of the sequence of said energy values of the subsequent frames.

19. The method of claim 14, wherein said analyzer is a linear predictive coding analyzer.

20. The method of claim 14, wherein said speech parameters of each of said frame also indicate the voiced/unvoiced status of said respective frame.

21. The method of claim 20, wherein said parameters also include pitch information for each of said speech frames, and wherein said analyzer jointly determines pitch and voicing of each frame, so that the said pitch and voicing decisions vary as smoothly as possible across adjacent frames.

22. The method of claim 16, wherein said speech parameters comprise linear predictive coding parameters.

23. The method of claim 22, wherein said speech parameters include excitation information in addition to said linear predictive coding parameters.

24. The method of claim 23, wherein said excitation information consists only of pitch, energy, and voicing information.

25. The method of claim 22, wherein said linear predictive coding parameters comprise reflection coefficients.

26. The method of claim 22, wherein said linear predictive coding parameters correspond to a tenth-order linear predictive coding model.

* * * * *